US009196982B2

(12) United States Patent
Sasaki et al.

(10) Patent No.: US 9,196,982 B2
(45) Date of Patent: Nov. 24, 2015

(54) CIRCUIT BOARD-CIRCUIT BOARD CONNECTOR

(75) Inventors: Kenta Sasaki, Tokyo (JP); Masami Sasao, Tokyo (JP)

(73) Assignee: Molex, LLC, Lisle, IL (US)

( * ) Notice: Subject to any disclaimer, the term of this patent is extended or adjusted under 35 U.S.C. 154(b) by 130 days.

(21) Appl. No.: 13/821,626

(22) PCT Filed: Sep. 8, 2011

(86) PCT No.: PCT/US2011/050824
§ 371 (c)(1),
(2), (4) Date: Sep. 11, 2013

(87) PCT Pub. No.: WO2012/033913
PCT Pub. Date: Mar. 15, 2012

(65) Prior Publication Data

US 2013/0344710 A1 Dec. 26, 2013

(30) Foreign Application Priority Data

Sep. 8, 2010 (JP) ..... 2010-200916

(51) Int. Cl.
*H01R 12/00* (2006.01)
*H01R 12/71* (2011.01)

(52) U.S. Cl.
CPC ..... *H01R 12/71* (2013.01); *H01R 12/716* (2013.01)

(58) Field of Classification Search
CPC ..... H01R 23/688; H01R 13/6275
USPC ..... 439/108, 60, 637, 636, 405, 357
See application file for complete search history.

(56) References Cited

U.S. PATENT DOCUMENTS

| | | | | |
|---|---|---|---|---|
| 7,128,581 | B2 * | 10/2006 | Igarashi et al. | 439/74 |
| 7,568,919 | B2 | 8/2009 | Hoshino et al. | |
| 7,588,443 | B2 | 9/2009 | Wu et al. | |
| 8,083,527 | B2 | 12/2011 | Takeuchi et al. | |
| 2006/0276060 | A1 | 12/2006 | Takano | |
| 2010/0159717 | A1 | 6/2010 | Takeuchi | |
| 2013/0330943 | A1 | 12/2013 | Sasaki et al. | |

FOREIGN PATENT DOCUMENTS

| | | | |
|---|---|---|---|
| CN | 201060978 | Y | 5/2008 |
| CN | 201270300 | Y | 7/2009 |
| JP | 2010-015739 | A | 1/2010 |

OTHER PUBLICATIONS

International Search Report for PCT/US2011/050824.

* cited by examiner

*Primary Examiner* — Phuongchi T Nguyen

(57) ABSTRACT

A first connector is provided with a first terminal and a first housing that has a first mating guide portion, and a second connector is provided with a second terminal and a second housing that has a second mating guide portion. The first mating guide portion includes a recessed portion into which the second mating guide portion is inserted, and an end wall portion, wherein the inside faces thereof define the length-wise-direction outsides of the first housing in the recessed portion.

12 Claims, 9 Drawing Sheets

CIRCUIT BOARD-CIRCUIT BOARD CONNECTOR

REFERENCE To RELATED APPLICATIONS

The Present Application claims priority to prior-filed Japanese Patent Application No. 2010-200916, entitled "Circuit Board-Circuit Board Connector," filed on Sep. 8, 2010 with the Japanese Patent Office. The contents of the aforementioned Patent Application is fully incorporated in its entirety herein.

BACKGROUND OF THE PRESENT APPLICATION

The present invention relates, generally, to a circuit board-circuit board connector.

Conventionally, a circuit board-circuit board connector has been used to connect electrically a pair of parallel circuit boards to each other. Such circuit board connectors have been attached to each of mutually facing faces of a pair of circuit boards and have been mated together so as to be electrically conductive. See, for example, Japanese Patent Application Publication No. 2008-84796.

FIG. 9 is a perspective diagram illustrating the state prior to the conventional circuit board-circuit board connectors being mated together. In the drawing, 801 is a first connector as one of a pair of circuit board-circuit board connectors, and is mounted on the front face of a first circuit board, not shown. Moreover, 901 is a second connector, as the other of the pair of circuit board-circuit board connectors, and is mounted on the front face of a second circuit board, not shown. The first connector 801 has a first housing 811 and a plurality of first terminals 861, equipped in the first housing 811, and the second connector 901 has a second housing 911 and a plurality of second terminals 961 equipped in the second housing 911. Note that 862 and 962 are tail portions of the first terminals 861 and the second terminals 961, respectively, and are soldered to terminal connecting pads of the first circuit board and the second circuit board.

Moreover, a recessed portion 812, for containing the second housing 911, is formed in the first housing 811. In addition, when the first connector 801 and the second connector 901 are mated together, the first circuit board and the second circuit board are connected electrically through the corresponding first terminals 861 and second terminals 961 contacting each other.

SUMMARY OF THE PRESENT APPLICATION

However, with the conventional circuit board-circuit board connector, set forth above, the first housing 811 or the second housing 911 may become scratched or damaged at the time of the mating operation. Depending on the operating conditions when the first connector 801 that is attached to the first circuit board and the second connector 901 that is attached to the second circuit board are mated together, it may not be possible for the operator to see the mating face of the first housing 811 and the mating face of the second housing 911, and so must perform the mating operation through a manual search. In particular, because of advancements in miniaturization and low-profile designs of circuit board-circuit board connectors in recent years, it has become difficult for the operator to see the mating face of the first housing 811 and the mating face of the second housing 911.

In this case, the operator must adjust the position of the second housing 911 relative to that of the first housing 811 while sliding the mating face of the first housing 811 and the mating face of the second housing 911 against each other in the manual search, to insert the second housing 911 into the recessed portion 812 of the first housing 811.

Because of this, in some cases, pressure is applied to the first housing 811 and the second housing 911 in the mating direction in a state wherein the alignment between the first housing 811 and the second housing 911 is imperfect. In this case, a portion of the mating face of the first housing 811 and a portion of the mating face of the second housing 911 are subjected to a large pressing force, so may become scratched or damaged. In particular, guide portions 821, which are formed on both lengthwise-direction ends of the first housing 811, have relatively thin wall thicknesses, and thus are damaged easily when, for example, struck at an angle by a lengthwise-direction end portion of the second housing 911.

The object of the present invention is to solve the problem area set forth above with the conventional circuit board-circuit board connector, and to provide a highly reliable circuit board-circuit board connector with excellent ease in operations, without the lengthwise-direction mating guide portions of the first housing of the first connector becoming scratched or damaged during the mating operation, doing so through the provision of reinforcing hardware at the mating guide portions at both lengthwise-direction ends of the first housing of the first connector into which the second housing of the second connector is mated.

Because of this, the circuit board-circuit board connector as set forth in the present invention comprises: a first connector comprising a first terminal, and a first housing having first mating guide portions formed on both ends in the lengthwise direction; and a second connector comprising a second terminal that contacts the first terminal, and a second housing that has second mating guide portions, formed on both ends in the lengthwise direction, that mate with the first mating guide portions; wherein: a first mating guide portion includes a recessed portion into which a second mating guide portion is inserted, and an end wall portion that extends in the direction of thickness of the first housing, wherein the inside faces thereof define the outsides, in the direction of length of the first housing, in the recessed portion; reinforcing hardware is attached to the first mating guide portions; and the reinforcing hardware includes: a main unit portion that extends in the direction of width of the first housing and includes a center portion that covers at least a portion of a mating side face of the end wall portion, and a tongue piece portion that is connected to the center portion and that covers at least a portion of an inside face of the end wall portion; and a circuit board connecting portion that is connected to the main unit portion, and wherein a free end is secured to a circuit board.

In another circuit board-circuit board connector according to the present invention, the center portion and the tongue piece portion extend in directions that are perpendicular to each other, and the main unit portion has a section modulus of an essentially a L shape.

In another circuit board-circuit board connector according to the present invention, the reinforcing hardware includes a held portion that is connected to the main unit portion through a corner portion that extends at an angle from the center portion towards the lengthwise-direction center portion of the first housing, the held portion extends in the direction of thickness of the first housing and is held in the first housing, and the circuit board connecting portion is connected to one end of the held portion.

In another circuit board-circuit board connector according to the present invention, the first terminal includes a tail portion that is connected to an electrically conductive trace of the circuit board; and the circuit board connecting portion is disposed lined up in a direct line with a plurality of tail portions.

Given the present invention, reinforcing hardware is provided at the mating guide portions on both lengthwise-direction ends of the first housing of the first connector into which the second housing of the second connector is inserted in the circuit board-circuit board connector according to the present invention. Doing so makes it possible to improve the ease of operation without the lengthwise-direction mating guide portions of the first housing of the first connector becoming scratched or damaged during the mating operation.

BRIEF DESCRIPTION OF THE FIGURES

The organization and manner of the structure and operation of the Present Application, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Application may be susceptible to embodiment in different forms, there is shown in the Figures, and will be described herein in detail, specific embodiments, with the understanding that the disclosure is to be considered an exemplification of the principles of the Present Application, and is not intended to limit the Present Application to that as illustrated.

In the embodiments illustrated in the Figures, representations of directions such as up, down, left, right, front and rear, used for explaining the structure and movement of the various elements of the Present Application, are not absolute, but relative. These representations are appropriate when the elements are in the position shown in the Figures. If the description of the position of the elements changes, however, these representations are to be changed accordingly.

In the figures, 1 is a first connector as one of the connectors of a pair of circuit board-circuit board connectors in the present form of embodiment, and is a surface mount-type connector that is mounted on the surface of a first circuit board, not shown. Furthermore, 101 is a second connector that is the other connector of a pair of circuit board-circuit board connectors in the present form of embodiment, that is, is the opposite connector, being a surface mount-type connector that is mounted on the surface of a second circuit board, not shown. The circuit board-circuit board connector in the present form of embodiment includes the first connector 1 and the second connector 101, and is connected electrically to the first circuit board and the second circuit board. Note that the first circuit board and the second circuit board are, for example, printed circuit boards, flexible flat cables (FFCs), flexible printed circuit boards (FPCs), or the like, that are used in electronic devices, or the like, but may be substrates of any type.

Figure 1A:
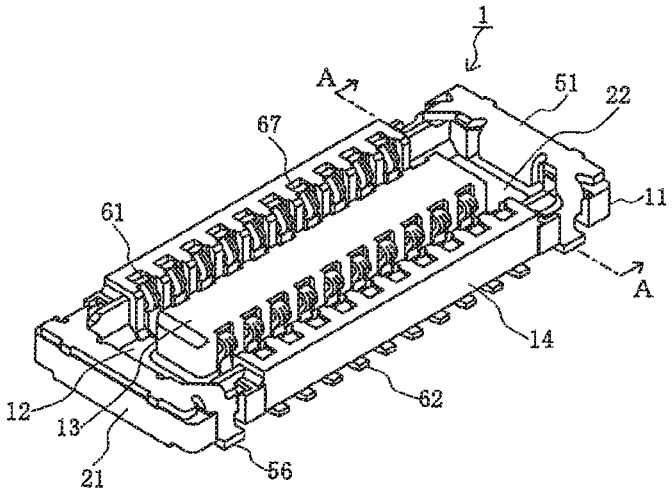
FIG. 1 is a perspective diagram of the first connector in a form of embodiment according to the present invention, where (a) is a diagram when viewed from the first connector mating face side and (b) is a diagram when viewed from the first connector mounting face side.
Figure 1B:
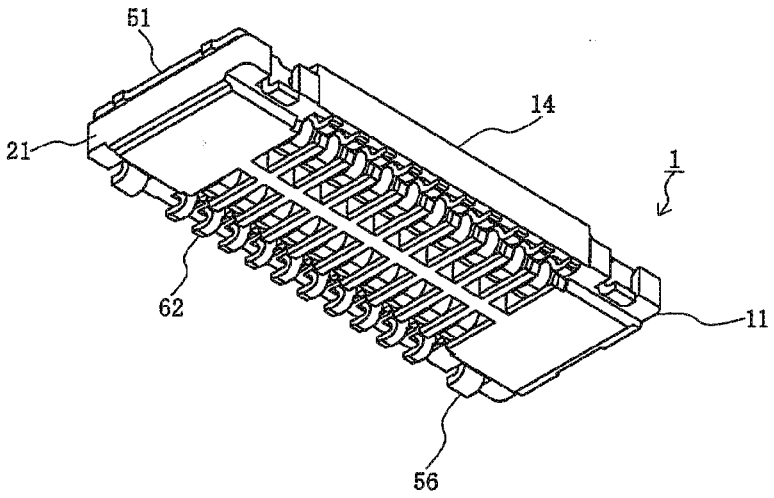
Figure 2:
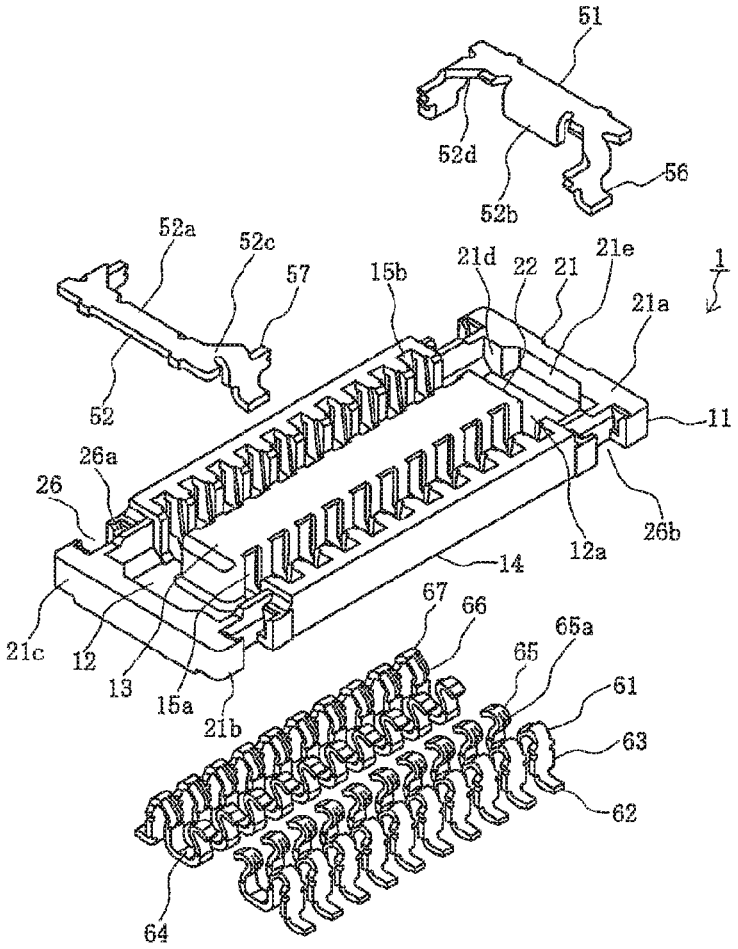
FIG. 2 is an assembly diagram of the first connector in a form of embodiment according to the present invention, a diagram when viewed from the mating face side.
Figure 3A:
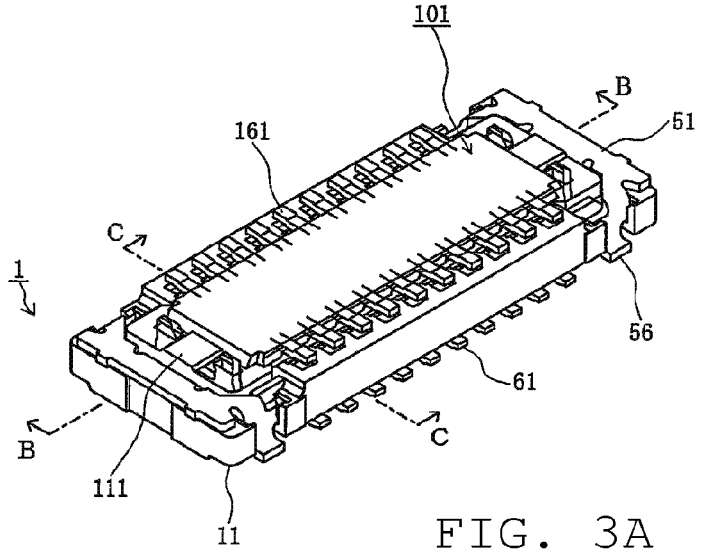
FIG. 3 is a perspective diagram showing the state wherein the first connector and the second connector are mated together in a form of embodiment according to the present invention, where (a) is a diagram when viewed from the first connector mating face side and (b) is a diagram when viewed from the first connector mounting face side.
Figure 3B:
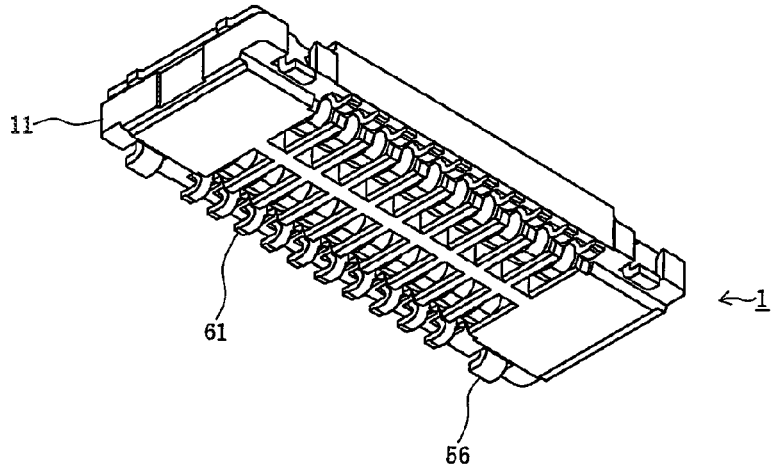
Figure 4:
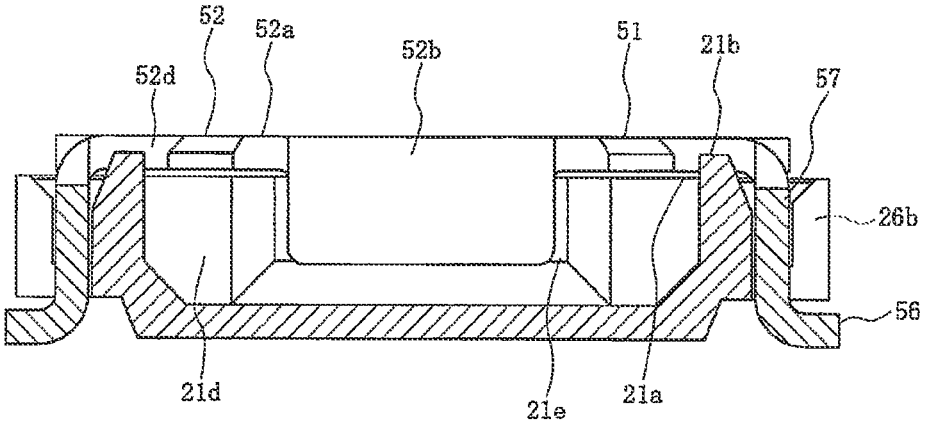
FIG. 4 is a cross-sectional diagram of the first connector in a form of embodiment according to the present invention, a cross-sectional diagram along the section A-A in FIG. 1.

Additionally, the first connector 1 has a first housing, as a connector main unit that is formed integrally from an insulating material such as a synthetic resin or the like. The first housing 11, as illustrated, has a shape that is a thick plate that is essentially rectangular, that is, essentially a rectangular prism, and a recessed portion 12, of essentially a rectangular shape that is encompassed by its surrounding, is formed on the side into which the second connector 101 is fitted, that is, on the mating face side (the top side in FIG. 2). The first connector 1 has, for example, dimensions of 10.0 mm long, 2.5 mm wide, and about 1.0 mm thick, but these dimensions may be modified as appropriate. Given this, a first raised portion 13 is formed integrally with the first housing 11 as an island portion, in the recessed portion 12, and side wall portions 14 that extend in parallel with the first raised portion 13 are formed, on both sides of the first raised portion 13, integrally with the first housing 11. In this case, the first raised portion 13 and the side wall portions 14 protrude upwards from the bottom face of the recessed portion 12, and extend in the lengthwise direction of the first housing 11. As a result, recessed grooved portions 12*a*, which are long and thin recessed portions that extend in the lengthwise direction of the first housing 11, are formed, as portions of the recessed portion 12, between the first raised portion 13 and the side wall portions 14, on both sides of the first raised portion 13. Note that while in the example that is illustrated, the first raised portion 13 is singular, it may instead be plural, and the number thereof may be several. Additionally, while the first raised portion 13 has, for example, a width dimension of about 0.6 mm, the dimension may be modified as appropriate.

Here recessed groove-shaped first terminal containing inside cavities 15*a* are formed on the side faces on both sides of the first raised portion 13. Additionally, recessed groove-shaped first terminal containing outside cavities 15*b* are formed on side faces on the insides of the side wall portions 14. Moreover, the first terminal containing inside cavities 15*a* and the first terminal containing outside cavities 15*b* are connected by the bottom face of the recessed groove portion 12*a* and are integrated together, and thus when explaining the first terminal containing inside cavity 15*a* and the first terminal containing outside cavity 15*b* overall, they are explained as the first terminal containing cavity 15.

Ten first terminal containing cavities 15 are formed on both sides of the first raised portion 13 with a pitch of about 0.4 mm, for example. Furthermore, ten first terminals 61, which are contained in each of the first terminal containing cavities 15, are disposed on both sides of the first raised portion 13 with a pitch of about 0.4 mm, for example. Note that the pitch and number of the first terminal containing cavities 15 can be modified as appropriate.

A first terminal 61 is a member that is formed integrally through performing processes such as punching and bending on an electrically conductive metal sheet, and is provided with: a held portion 63; a tail portion that is connected to the bottom end of the held portion 63; a top side connecting portion 67 that is connected to the top end of the held portion 63; a second contacting portion 66, as a second contacting raised portion that is formed in the vicinity of the inner end of the top side connecting portion 67; a first contacting portion 65 that is formed in the vicinity of the free end of the bottom side connecting portion 64; and a first contacting raised portion 65*a* that is formed in the first contacting portion 65.

Additionally, the held portion 63 is a part that extends in the vertical direction, that is, in the direction of thickness of the first housing 11, and is held through insertion into the first terminal containing outside cavity 15*b*. Moreover, the tail portion 62 is bent relative to the held portion 63 and is connected to extend towards the outside in the left/right direction, that is, in the direction of width of the first housing 11, to be connected through soldering, or the like, to a terminal connecting pad that is connected to an electrically conductive trace on the first circuit board. Moreover, the top side connecting portion 67 is bent relative to the held portion 63 and connected to extend towards the inside in the direction of width of the first housing 11.

An arced second contacting portion 66 is formed on the inward end of the top side connecting portion 67, bent downward and facing toward the inside in the direction of width of the first housing 11. Moreover, the bottom side connecting portion 64 is a part that is provided with a U-shaped side face shape that is connected to the bottom end of the second contacting portion 66. The arc-shaped first contacting portion 65 is bent into a U shape, and extends towards the outside in the direction of width of the first housing 11, in the vicinity of the free end, that is, the top end, toward the inside of the bottom side connecting portion 64.

The first terminals 61 are fitted into the first terminal containing cavity 15 from the mounting face side (the bottom side in FIG. 2), and the held portion 63 is held from both sides by the side walls of the first terminal containing outside cavities 15*b* that are formed on the side faces on the inside of the side wall portions 14, to be secured to the first housing 11. In this state, that is, in the state wherein the first terminals 61 are inserted into the first housing 11, the first contacting portions 65 and the second contacting portions 66 are positioned on both the left and right sides of the recessed groove portions 12*a*, and face each other.

Note that each first terminal 61 is a member that is formed integrally through performing machining on a metal sheet, and thus is provided with some degree of elasticity. Given this, as is clear from the shape, elastic deformation is possible in the gap over which the first contacting portion 65 and the second contacting portion 66 face each other. That is, when the second terminal 161 is inserted between the first contacting portion 65 and the second contacting portion 66, the gap between the first contacting portion 65 and the second contacting portion 66 is an enlarged thereby.

Moreover, first protruding end portions 21 are disposed, as first mating guide portions, at both lengthwise-direction ends of the first housing 11. A protruding end recessed portion 22 is formed, as a portion of the recessed portion 12, in each first protruding end portion 21. The protruding end recessed portions 22 are rectangular recessed portions, and connected to both lengthwise-direction ends of the individual recessed groove portions 12*a*. Moreover, each protruding end recessed portion 22 functions as an insertion recessed portion into which the second protruding end portion 122, described below, is inserted.

Moreover, the first protruding end portions 21 are provided with side wall extension portions 21*b* that extend in the lengthwise direction of the first housing 11 from both of the lengthwise-direction ends of the side wall portions 14, and end wall portions 21*c*, which extend in the short direction of the first housing 11, and which are connected on both sides to the side wall extension portions 21*b*. In each of the first protruding end portions 21, the end wall portions 21*c* and the side wall extension portions 21*b*, which are connected on both ends thereof, form continuous U-shaped side walls, to define three sides of the essentially rectangular protruding end recessed portion 22.

Given this, first reinforcing hardware 51 are attached, as reinforcing hardware, to the first protruding end portions 21. The first reinforcing hardware 51 is disposed so as to cover at least a portion of the top face 21*a*, as a mating side face for the end wall portion 21*c*, and is held contained within a first hardware holding recessed portion 26 that is formed in the side wall extension portion 21*b* of the first protruding end portion 21.

In the present form of embodiment, the first reinforcing hardware 51 is a member that is formed integrally through performing processing such as punching and bending on a metal sheet (which has, for example, a thickness of about 0.1 mm), and, overall, comprises: a first main unit portion 52, as a main unit portion that extends in the direction of width of the first housing 11; first leg portions 57, wherein both the left and right ends of the first main unit portion 52 are bent and connected to extend in the direction of thickness of the first housing 11 (the up/down direction in FIG. 2), as held portions that are held in the first housing 11; and first circuit board connecting portions 56, as circuit board connecting portions that are connected to the bottom ends of the first leg portions 57.

Additionally, the first main unit portion 52 comprises: a center portion 52*a* of a long thin belt shape that extends in a straight line in the direction of width of the first housing 11, parallel to the mating face of the first housing 11; a tongue piece portion 52*b* that extends in the downward direction, that is, toward the mounting face, from the inner edge (the edge that faces the lengthwise-direction center of the first housing 11) in the central part of the center portion 52*a;* and corner portions 52*c* that extend at an angle towards the lengthwise-direction center of the first housing 11 from the vicinities of both ends of the center portion 52*a*.

Typically, the center portions 52*a* is formed with a shape and size to cover the entirety of the top face 21*a* of the end wall portion 21*c*, and is disposed so as to cover the entirety of the top face 21*a;* however, it is not necessarily a requirement that the entirety of the top face 21*a* be covered, and it is acceptable if only a portion of the top face 21*a* is covered.

Additionally, in the tongue piece portion 52*b*, the top end thereof is bent and connected at the top face 21*a*, to extend in the direction of thickness of the first housing 11, and is disposed so as to cover at least a portion of the inside face 21*d* (the edge facing the lengthwise-direction center of the first housing 11) of the end wall portion 21*c*. Note that while in the example that is illustrated the tongue piece portion 52*b* is contained within the recessed portion 21*e* that is formed in the inside face 21*d* of the end wall portion 21*c* and is formed so as to be essentially coplanar with the inside faces 21*d* that are positioned on both sides of the recessed portion 21*e*, it is not necessarily a requirement that the recessed portions 21*e* be formed in the inside faces 21*d*, to contain the tongue piece portion 52*b*. It is acceptable for the tongue piece portion 52*b* to cover the entirety of the inside face 21*d*.

Furthermore, the corner portions 52*c* extend in the same plane as the center portion 52a, and the tip ends thereof are connected to the top ends of the first leg portions 57. Moreover, the inside edges of the corner portions 52*c* form oblique edges 52*d* that are angled relative to the lengthwise direction and the crosswise direction of the first housing 11. Moreover, the oblique edges 52*d* are positioned at both corners of the outside edges (the edges facing in the lengthwise-end direction of the first housing 11) of the protruding end recessed portions 22, so that when the second protruding end portions 122 of the second connector 101 are inserted into the protruding end recessed portions 22, they function as guide portions to guide the second protruding end portions 122 into the protruding end recessed portions 22. Moreover, the existence of the corner portions 52*c* increase the strength of the first reinforcing hardware 51, particularly when there is a force in the direction of width of the first housing 11. Furthermore, the corner portions 52*c* extend in the same plane as the center portion 52*a*, and thus the top faces 21*a* of the end wall portions 21*c* are covered and protected over a wider area.

The first hardware holding recessed portion 26 comprises: a first leg portion containing portion 26*a* that is groove shaped and that extends in the direction of thickness and the direction of length of the first housing 11; and a connecting portion containing an opening portion 26*b* that is connected to the first leg portion containing portion 26*a* and that opens to the outer face of the side wall extension portion 21*b*. Given this, the first leg portion 57 of the first reinforcing hardware 51 is contained in and held by the first leg portion containing portion 26*a*. Additionally, in the first circuit board connecting portion 56, the free end thereof is bent so as to face the outside, in the direction of width of the first housing 11, and connected to the bottom end of the first leg portion 57. The first circuit board connecting portion 56 functions as a solder tail portion of the first reinforcing hardware 51, and the bottom face of the free end thereof is formed so as to be essentially parallel to the mounting face of the first housing 11, and is secured, through soldering, or the like, to a securing pad on the first circuit board.

The second connector 101 has a second housing 111 as a connector main unit formed integrally from an insulating material. The second housing 111, as illustrated, is provided with an essentially rectangular thick plate shape that is essentially a rectangular prism, and has dimensions of, for example, a length of 8.0 mm, a width of 1.5 mm, and a thickness of 0.8 mm; however, these dimensions can be modified as appropriate. Moreover, on the side of the second housing 111 that is fitted into the first connector 1, that is, on the mating face side (the top side in FIG. 5 (*a*)), a long and thin recessed groove portion 113 that extends in the long direction of the second housing 111, and second raised portions 112, which not only define the outside of the recessed groove portion 113 but also extend in the lengthwise direction of the second housing 111, are formed integrally. The second raised portions 112 are formed along both sides of the recessed groove portion 113, and along both sides of the second housing 111. Moreover, second terminals 161 are disposed as terminals in each of the second raised portions 112.

Figure 5A:
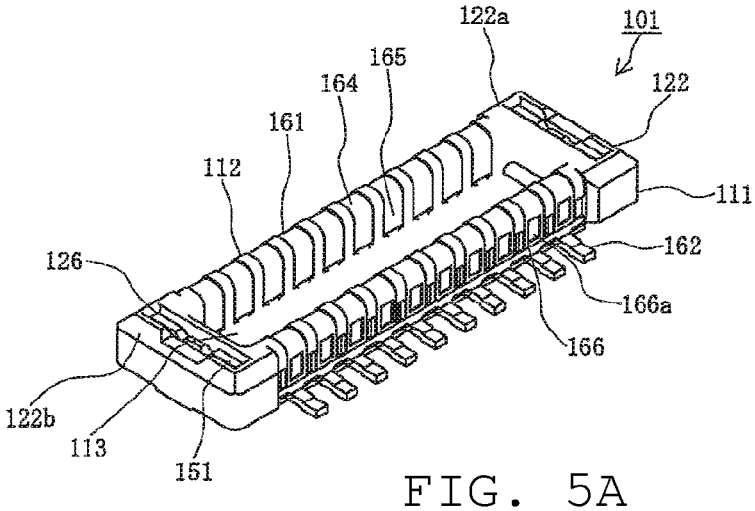
FIG. 5 is a perspective diagram of a second connector in a form of embodiment according to the present invention, where (a) is a diagram when viewed from the second connector mating face side and (b) is a diagram when viewed from the second connector mounting face side.
Figure 5B:
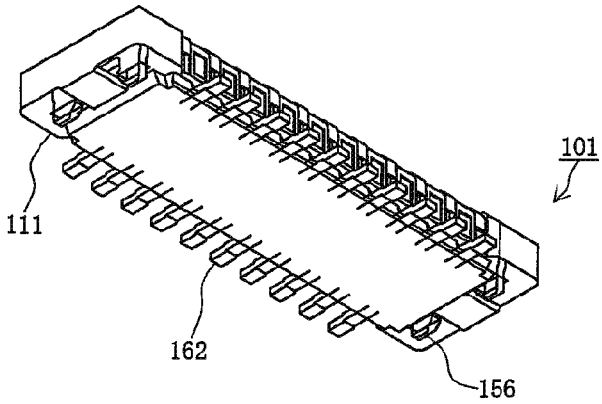

As shown in the drawings, in the recessed groove portion 113, the side that is mounted on the second circuit board, that is, the mounting face side (the bottom face in FIG. 5 (*b*)), is closed by a bottom portion. Note that while in the example that is illustrated there are two second raised portions 112, this may instead be singular, or there may be several. Moreover, the recessed groove portion 113 has a width dimension of, for example, about 0.7 mm, although the invention may be modified as appropriate.

The second terminals 161 are members that are formed integrally through performing processing, such as punching or bending, on an electrically conductive metal sheet, and comprises: a main unit portion, not illustrated; a tail portion 162 that is connected to the bottom end of the main unit portion; a first contacting portion 165 that is connected to the top end of the main unit portion; a connecting portion 164 that is connected to the top end of the first contacting portion 165; and a second contacting portion 166 that is connected to the outer end of the connecting portion 164. Note that respective second contacting recessed portions 166*a* that mate with the second contacting portions 66 of the first terminals 61, are formed on the surfaces of the second contacting portions 166.

Additionally, the main unit portion is held by the surrounding thereof being surrounded by the second housing 111, a part that is not shown in FIG. 5. Moreover, the tail portion 162 is connected to the bottom end that extends in the left/right direction of the main unit portion, that is, in the direction of width of the second housing 111, and extends facing towards the outside of the second housing 111, and is connected, through soldering, or the like, to a terminal connecting pad that is connected to an electrically conductive trace on the second circuit board.

Furthermore, the first contacting portion 165 is a flat plate part connected to the main unit portion and that extends in the vertical direction, that is, in the direction of thickness of the second housing 111. Moreover, the connecting portion 164 is bent relative to the first contacting portion 165 and is connected so as to extend facing towards the outside in the direction of width of the second housing 111. Moreover, the second contacting portion 166 is a part bent downward and connected to the outer end of the connecting portion 164 so as to extend downward.

The second terminal 161 is integrated with the second housing 111 through over-molding. That is, the second housing 111 is formed through filling resin into the cavity of a metal die into which the second terminals 161 have been placed in advance. As a result, in the second terminals 161, the main unit portions are embedded within the second housing 111, and the surfaces of the first contacting portions 165, the connecting portions 164, and the second contacting portions 166 are in a state wherein they are exposed to the mating face and each of the side faces of the second raised portion 112, to be attached integrally with the second housing 111. In this case, ten each of the second terminals 161 are disposed on both the left and the right with a pitch of, for example, about 0.4 mm, which may be modified as appropriate.

Additionally, second protruding end portions 122 are disposed as second mating guide portions on both of the lengthwise-direction ends of the second housing 111. A second protruding end portion 122 is a thick-wall member that extends in the direction of width of the second housing 111, and both ends thereof are connected to the lengthwise-direction ends of the second raised portion 112, where the top face 122*a* thereof has an essentially rectangular shape. Note that the side edges of the top face 122*a* (the edges facing the directions of the lengthwise ends of the second housing 111 and the edges facing both ends in the direction of width) have the angled taper face 122*b* connected thereto. Additionally, the second protruding end portion 122 functions as an insertion raised portion that is inserted into the protruding end recessed portion 22 of the first protruding end portion 21 that is provided in the first connector 1, in the state wherein the first connector 1 and the second connector 101 are mated. Furthermore, the taper face 122*b* functions as a guide portion for getting the second protruding end portion 122 into the protruding end recessed portion 22.

Additionally, a second reinforcing hardware 151 is attached, as reinforcing hardware, to the second protruding end portion 122. Specifically, a slot-shaped second hardware holding recessed portion 126 that extends in the direction of width and the direction of thickness of the second housing 111 is formed in the second protruding end portion 122, and the second reinforcing hardware 151 is contained and held in the second hardware holding recessed portion 126. Note that when in the state wherein it is contained in the second hardware holding recessed portion 126, the top end of the second reinforcing hardware 151 may protrude above the top face 122*a* of the second protruding end portion 122.

In the present form of embodiment, the second reinforcing hardware 151 is, overall, a long, thin belt-shaped member that extends in the direction of width of the second housing 111, formed integrally through performing processes, such as punching, on a metal sheet (which has a thickness of, for example, approximately 0.2 mm). The second reinforcing hardware 151 is provided with a second circuit board connecting portion 156 that protrudes downward. The second circuit board connecting portion 156 functions as a solder tail portion of the second reinforcing hardware 151, and the bottom face thereof is formed so as to be essentially parallel with the mounting face of the second housing 111, and is secured through soldering, or the like, to a securing pad on the second circuit board.

Here, in the first connector 1, not only is the tail portion 62 of each first terminal 61 connected through soldering or the like, to a terminal connecting pad that is connected to an electrically conductive trace on the first circuit board, not shown, but also the first circuit board connecting portion 56 of the first reinforcing hardware 51 is connected through soldering or the like to a securing pad on the first circuit board, to be surface-mounted on the first circuit board.

Similarly, in the second connector 101, not only is the tail portion 162 of each second terminal 161 connected through soldering or the like, to a terminal connecting pad that is connected to an electrically conductive trace on the second circuit board, not shown, but also the second circuit board connecting portion 156 of the second reinforcing hardware 151 is connected through soldering or the like to a securing pad on the second circuit board, to be surface-mounted on the second circuit board.

Here the first connector 1 and the second connector 101 respectively are mounted on the first circuit board and the second circuit board, which have large surface areas, and so the explanation will be for when an operation is performed for mating through manual searching where the operator is unable to see the mating face of the first connector 1 or the mating face of the second connector 101.

Figure 6:
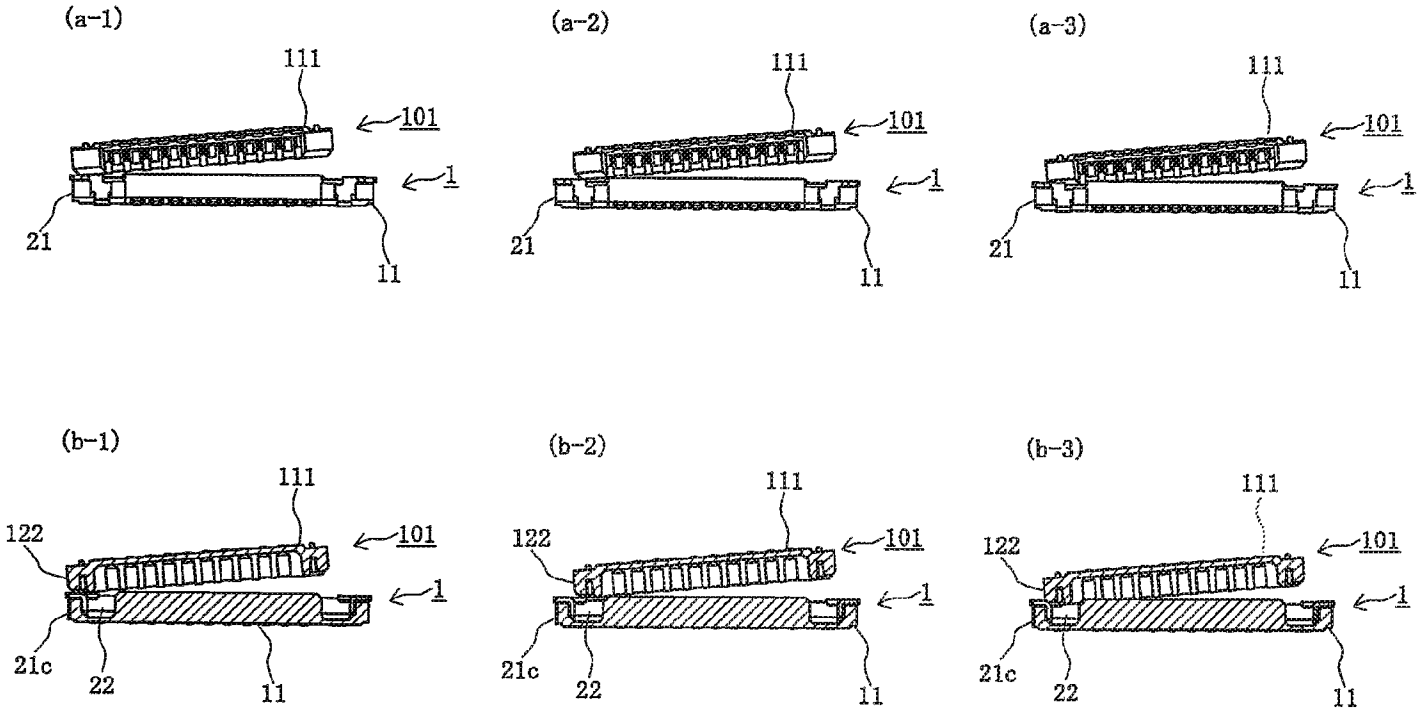
FIG. 6 is a diagram showing an example of the positional relationship between the first connector and the second connector in a mating process for a circuit board-circuit board connector in a form of embodiment according to the present invention, wherein (a-1) through (a-3) are cross-sectional diagrams illustrating first through third examples of positional relationships between the first connector and the second connector, and (b-1) through (b-3) are cross-sectional diagrams corresponding to (a-1) through (a-3)

First the operator causes the mating face of the first connector 1 to face the mating face of the second connector 101, and moves the first connector 1 and/or the second connector 101 in the direction approaching the other, that is, in the mating direction, to cause a portion of the mating face of the first connector 1 to contact a portion of the mating face of the second connector 101. In this state, this is manual searching, so accurate positional alignment is not possible, and, as illustrated in FIG. 6, there will be misalignment between the position of the first connector 1 and the position of the second connector 101. Note that here the first terminals 61 do not protrude beyond the mating face of the first connector 1, and the second terminals 161 also do not protrude beyond the mating face of the second connector 101. Because of this, in this state the first terminals 61 and the second terminals 161 are separate from each other, and do not contact each other. Consequently, even if there is sliding motion between the first connector 1 and the second connector 101, the first terminals 61 and the second terminals 161 do not contact each other, so do not become scratched.

In the example illustrated in FIGS. 6 (a-1) and (b-1), the second connector 101 is in a state wherein there is a large misalignment in the long direction relative to the first connector 1, and in a state wherein the mating face of the second connector 101 is at an angle relative to the mating face of the first connector 1. When, while in the state, the operator moves the first connector 1 and/or the second connector 101 in the mating direction, the second protruding end portion 122 that is on the left side of the second connector 101 in the figure will contact the end wall portion 21*c* of the first protruding end portion 21 that is on the left side of the first connector 1 in the figure, and thus the end wall portion 21*c* will receive a large pressing force in the mating direction, that is, a large pressing force downward from above in the figure, from the second protruding end portion 122.

However, in the present form of embodiment, the first reinforcing hardware 51 is attached to the first protruding end portion 21 so as to cover the top face 21*a* of the end wall portion 21*c*, and the top face 21*a* is covered by the center portion 52*a* of the first main unit portion 52 of the first reinforcing hardware 51, and, additionally, the first circuit board connecting portion 56 of the first reinforcing hardware 51 is secured to the securing pad on the first circuit board, and thus even if a large pressing force is received from the second protruding end portion 122, that pressing force is transferred from the center portion 52*a* of the first main unit portion 52 of the first reinforcing hardware 51 through the first circuit board connecting portion 56, and thus is essentially not propagated to the end wall portion 21*c*. Consequently, the end wall portion 21*c* does not become scratched or damaged.

Figure 7:
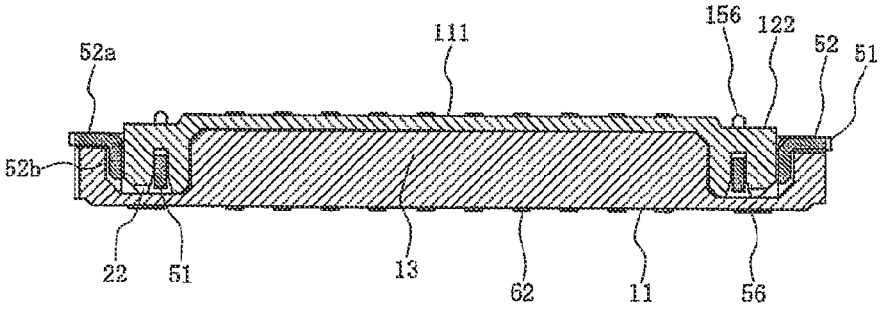
FIG. 7 is a side cross-sectional diagram showing the state wherein the circuit board-circuit board connector mating process has been completed in a form of embodiment according to the present invention, being a cross-sectional diagram along the section B-B in FIG. 3.

Furthermore, in the first main unit portion 52 of the first reinforcing hardware 51, as illustrated typically in FIG. 7, the tongue piece portion 52*b* that extends in the direction perpendicular to the direction of extension of the center portion 52*a* is connected to the inside edge of the center portion 52*a*, and thus the cross-sectional shape is essentially an L-shape, and the section modulus is large, so there is high strength. Because of this, even if the pressing force that is generated by the operator and that is propagated through the second protruding end portion 122 to the end wall portion 21*c* of the first protruding end portion 21 is large, the pressing force is effectively borne by the first main unit portion 52 of the first reinforcing hardware 51, so that essentially none of the pressing force is propagated to the end wall portion 21*c*. Consequently, even if the pressing force is large, the end wall portion 21*c* does not be damaged.

Furthermore, in the example illustrated in FIGS. 6 (a-3) and (b-3), the second connector 101 is in a state wherein there is a slight misalignment in the lengthwise direction relative to the first connector 1, and in a state wherein the mating face of the second connector 101 is at an angle relative to the mating face of the first connector 1. When, in this state, the operator moves the second connector 101 towards the left, in the figure, relative to the first connector 1, the second protruding end portion 122 on the left side of the second connector 101 in the figure will contact the inside face 21*d* of the end wall portion 21*c* of the first protruding end portion 21 on the left side of the first connector 1 in the figure, and thus the end wall portion 21*c* will be subject to a large pressing force in the lengthwise direction, that is, in the direction towards the left in the figure, from the second protruding end portion 122.

However, in the present form of embodiment, the inside face 21*d* of the end wall portion 21*c* is covered by the tongue piece portion 52*b* that is connected to the center portion 52*a* of the first main unit portion 52 of the first reinforcing hardware 51, and, additionally, the first circuit board connecting portion 56 of the first reinforcing hardware 51 is secured to a securing pad on the first circuit board, and thus even if a large pressing force is applied towards the lengthwise end direction from the second protruding end portion 122, that pressing force is transferred to the first circuit board from the tongue piece portion 52*b* of the first main unit portion 52 of the first reinforcing hardware 51 through the first circuit board connecting portion 56, so essentially none of it is transferred to the end wall portion 21*c*. Consequently, the end wall portion 21*c* does not become scratched or damaged.

Furthermore, the first main unit portion 52 of the first reinforcing hardware 51, as described above, has an L-shaped cross-sectional shape, and has a large section modulus, and thus has high strength. Because of this, even if the pressing force that is produced by the operator and that is directed in the direction of the lengthwise end, which is transferred through the second protruding end portion 122 to the end wall portion 21*c* of the first protruding end portion 21, is large, that pressing force can be borne effectively by the first main unit portion 52 of the first reinforcing hardware 51, and so essentially none of the pressing force is transferred to the end wall portion 21*c*. Consequently, even if this pressing force is large, the end wall portion 21*c* does not become scratched or damaged.

Note that in the example illustrated in FIGS. 6 (a-2) and (b-2) the second connector 101 is in a state wherein there is essentially no misalignment in the lengthwise direction relative to the first connector 1, the state is one wherein the mating face of the second connector 101 is at an angle relative to the mating face of the first connector 1. When, while in this state, the operator moves the first connector 1 and/or the second connector 101 in the mating direction, the second protruding end portion 122 that is on the left side of the second connector 101 in the figure will be inserted at an angle into the protruding end recessed portion 22 on the left side of the first connector 1 in the figure, and thus the end wall portion 21*c* of the first protruding end portion 21 that is on the left side of the first connector 1 in the figure will be subjected to a large pressing force from the second protruding end portion 122 at an angle relative to the mating direction.

However, in the present form of embodiment, the top face 21*a* of the end wall portion 21*c* is covered by the center portion 52*a* of the first main unit portion 52 of the first reinforcing hardware 51, the inside face 21*d* of the end wall portion 21*c* is covered by the tongue piece portion 52*b* that is connected to the center portion 52*a* of the first main unit portion 52 of the first reinforcing hardware 51, and the first circuit board connecting portion 56 of the first reinforcing hardware 51 is secured to the securing pad on the first circuit board, and thus even if a large pressing force is received at an angle from the second protruding end portion 122, that pressing force it is transferred from the center portion 52*a* of the first main unit portion 52 of the first reinforcing hardware 51 through the first circuit board connecting portion 56 to the first circuit board, and so essentially none of it is transferred to the end wall portion 21*c*. Consequently, the end wall portion 21*c* does not become scratched or damaged.

Furthermore, the first main unit portion 52 of the first reinforcing hardware 51, as described above, has an L-shaped cross-sectional shape, and a large section modulus, and thus has high strength. Because of this, even if the pressing force that is produced by the operator and that is transferred through the second protruding end portion 122 to the end wall portion 21*c* of the first protruding end portion 21 is large, that pressing force is born effectively by the first main unit portion 52 of the first reinforcing hardware 51, and so essentially none of the pressing force is transferred to the end wall portion 21*c*. As a result, even if the pressing force is large, still the end wall portion 21*c* does not become scratched or damaged.

Figure 8:
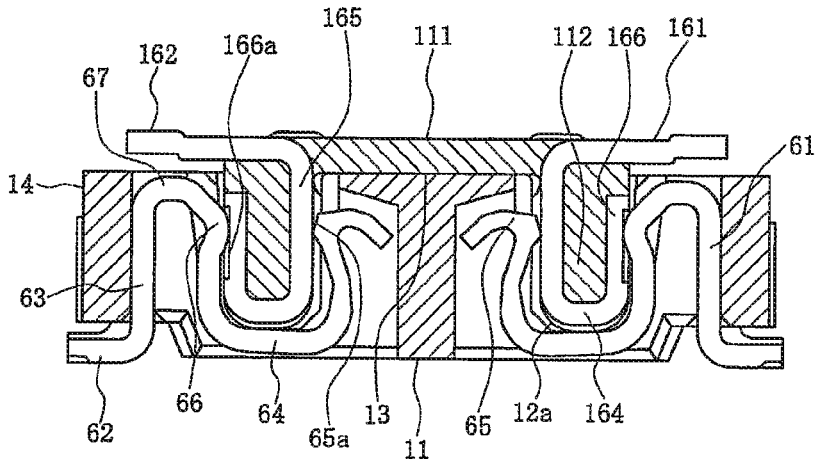
FIG. 8 is a width-direction cross-sectional diagram showing the state wherein the circuit board-circuit board connector mating process has been completed according to the present invention, being a cross-sectional diagram along the section C-C in FIG. 3.
Figure 9:
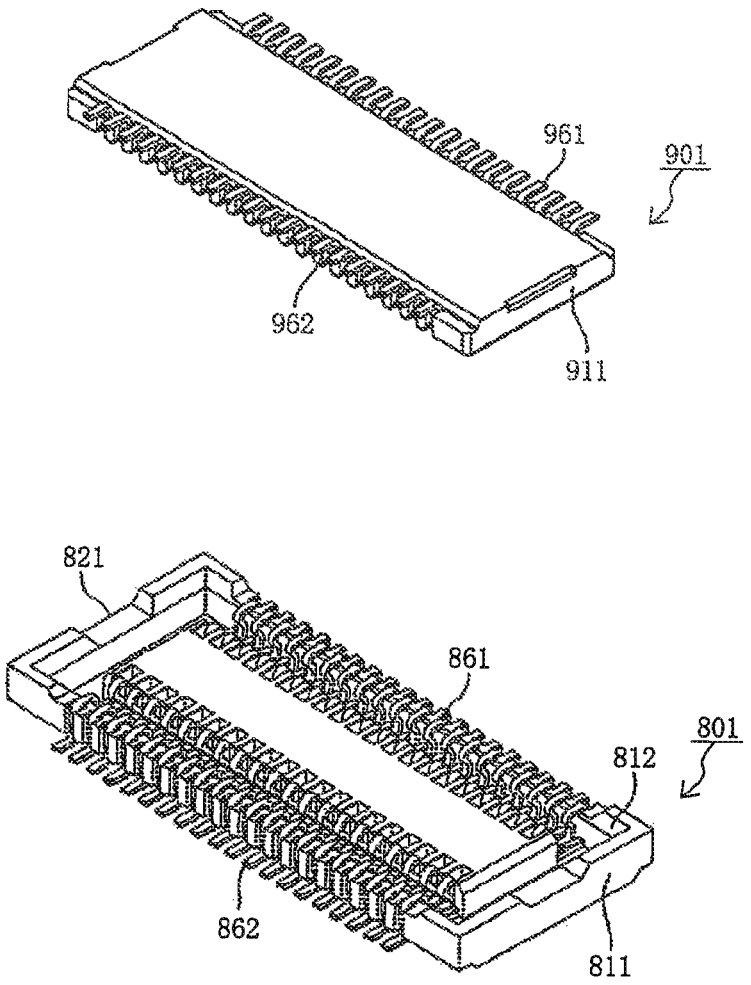
Prior art FIG. 9
FIG. 9 is a perspective diagram illustrating the state prior to mating in a conventional circuit board-circuit board connector.

Additionally, when the mating of the first connector 1 and the second connector 101 is finally completed, each of the second protruding end portions 122 of the second connector 101, as illustrated in FIG. 7, are inserted into the respective corresponding protruding end recessed portions 22 in the first connector 1. Moreover, as illustrated in FIG. 8, the left and right second raised portions 112 of the second connector 101 are inserted into the left and right recessed groove portions 12*a* of the first connector 1. Moreover, the second terminals 161 of the second connector 101 are inserted between the first contacting portion 65 and the second contacting portion 66 of the individual first terminals 61, so the first contacting portions 65 of the first terminals 61 and the first contacting portions 165 of the second terminals 161 make contact, and the second contacting portions 66 of the first terminals 61 and the second contacting portions 166 of the second terminals 161 make contact.

The result is that there will be electrical conductivity between the electrically conductive traces that are connected to the terminal connecting pads on the first circuit board, to which the tail portions 62 of the first terminals 61 are connected, and the electrically conductive traces that are connected to the terminal connecting pads on the second circuit board, to which the tail portions 162 of the second terminals 161 are connected.

Additionally, the second contacting portions 66 of the first terminals 61 will go into a state wherein they are interlocked with the second contacting recessed portions 166*a* of the second terminals 161. The result is that the first and second connectors 1, 101 will be locked.

Note that in the present form of embodiment no reinforcing hardware corresponding to the first reinforcing hardware 51 is provided in the second protruding end portion 122 of the second connector 101. This is because the second protruding end portion 122, when compared to the end wall portion 21*c* of the first connector 1, has a large dimension when it comes to the lengthwise direction of the second housing 111, that is, is a thick-walled, short wall-shaped member, so that it has high strength on its own, and thus will not become scratched or damaged even if it is subjected to some degree of pressing force. Of course, if one were to consider also the second protruding end portion 122 becoming scratched or damaged, then, as necessary, it is also possible to provide, on the second protruding end portion 122, reinforcing hardware corresponding to the first reinforcing hardware 51.

Moreover, although in the first reinforcing hardware 51 in the present form of embodiment the tongue piece portion 52*b* is connected to the inside edge of the center portion 52*a*, no member corresponding to the tongue piece portion 52*b* is connected to the outside edge of the center portion 52*a*. This is because the overall length of the first connector 1 would have to be longer if a member corresponding to the tongue piece portion 52*b* were to be connected to the outside edge of the center portion 52*a*, which would require a larger mounting space on the first circuit board. Of course, if necessary a member corresponding to the tongue piece portion 52*b* can also be connected to the outside edge of the center portion 52*a* as well. In this case, the cross-sectional shape of the first main unit portion 52 would be a U shape, so the section modulus would be larger, and the strength would be even higher.

Furthermore, the left and right first circuit board connecting portions 56 of the first reinforcing hardware 51 in the present embodiment are disposed so as to be lined up in a straight line with the tail portions 62 of the plurality of first terminals 61 that are lined up in a straight line to the left and right in the first housing 11. This is to make it possible to perform an inspection of the states of connections between the first circuit board connecting portions 56 and the securing pads on the first circuit board simultaneously with the inspection of the states of connections between the tail portions 62 and the terminal connecting pads on the first circuit board, in order to simplify the inspections of the states of connections between the first circuit board connecting portions 56 and the securing pads on the first circuit board. Moreover, even if an external force were to be applied to the first connector 1 that is mounted on the first circuit board, the first circuit board connecting portion 56, along with the tail portions 62, would disperse and bare the external force, so that the tail portions 62 would not detach from the terminal connecting pads.

Note that, if necessary, the positions of the first circuit board connecting portions 56 can be modified. For example, the positions of the first circuit board connecting portions 56 can be to the outside of the end wall portions 21*c*. However, in this case the supply of the components in the manufacturing process may become difficult. Moreover, there would be the possibility that the tail portions 62 would become detached from the terminal connecting pads if an external force were to act on the first connector 1 that is mounted on the first circuit board. Moreover, this would cause the dimension of the first connector 1 in the lengthwise direction to be larger.

In this way, in the present form of embodiment first reinforcing hardware 51 is attached to the first protruding end portions 21 of the first connector 1. Moreover, the first reinforcing hardware 51 includes a center portion 52*a* that covers at least a portion of the top face 21*a* of the end wall portion 21*c*, and a tongue piece portion 52*b*, which is connected to the center portion 52*a*, covering at least a portion of the inside face 21*d* of the end wall portion 21*c*, and includes a first main unit portion 52 that extends in the direction of width of the first housing 11, and a first circuit board connecting portion 56 that is connected to the first main unit portion 52 and that has a free end that is secured to the circuit board. As a result, even if a strong pushing force that is generated by the operator during the mating operation were to be received, the end wall portion 21*c* of the first protruding end portion 21, which is covered by the first main unit portion 52 of the first reinforcing hardware 51, would not become scratched or damaged. Consequently, even if the mating operation is performed through manual searching, the end wall portions 21*c* of the first protruding end portions 21 will not become scratched or damaged, thus making it possible to provide a highly reliable circuit board-circuit board connector that improves the ease of the mating operation.

While a preferred embodiment of the Present Application is shown and described, it is envisioned that those skilled in the art may devise various modifications without departing from the spirit and scope of the foregoing Description and the appended Claims.

What is claimed is:

1. A circuit board-circuit board connector comprising:

a first connector including a first terminal, and a first housing supporting the first terminal, the first housing having first mating guide portions formed on both ends in the lengthwise direction;

and a second connector including a second housing, the second housing supporting a second terminal for contacting the first terminal when the first and second connectors are mated together, the second housing including second mating guide portions, formed on both ends in the lengthwise direction, that mate with the first mating guide portions when the first and second connectors are mated together, the first housing further including a groove which receives the second connector second guide portions when the first and second connectors are mated together; and wherein each first mating guide portion includes an end wall extending widthwise of the first housing, the end wall forming at least portions of inner surfaces of the first housing groove, and a recess, adjacent to the first housing groove portions of the end wall flanking the recess defining portions of the first housing groove; and, reinforcing hardware disposed along the first mating guide portions, the reinforcing hardware including a main unit portion that extends widthwise of the first housing and a center portion that covers at least a portion of an upper surface of the end wall and a tongue portion connected to the center portion and extending downward therefrom into the endwall recess and defining a portion of the inner surface of the first housing groove, and a circuit board connecting portion joined to the main unit portion, a free end of which is configured for securing to a circuit board.

2. The circuit board-circuit board connector of claim 1, wherein the first terminal includes a tail portion for connecting to an electrically conductive trace of a circuit board.

3. The circuit board-circuit board connector of claim 1, wherein the reinforcing hardware further corner portions extending lengthwise at an angle from opposite ends of the center portions.

4. The circuit board-circuit board connector of claim 3, wherein the corner portions extend along the upper surfaces of the end walls of the first housing.

5. The circuit board-circuit board connector of claim 1, further including held portions extending vertically and held in the first housing.

6. The circuit board-circuit board connector of claim 5, wherein the circuit board connecting portion is connected to one end of the held portion.

7. The circuit board-circuit board connector of claim 1, wherein the center portion and the tongue piece portion extend in directions that are perpendicular to each other.

8. The circuit board-circuit board connector of claim 7, wherein the main unit portion has a section modulus of an essentially a L shape.

9. A board-to-board connector assembly, comprising:

a first connector having a first housing supporting a plurality of conductive first terminals, the first housing including a mating groove, the first housing further including end walls disposed at opposite thereof, the end walls having inner surfaces that define portions of the mating groove, and the end wall inner surfaces including recesses disposed therealong and communicating with the mating groove;

a second connector matable with the first connector and having a second housing supporting a plurality of conductive second terminals, the second housing including raised portions received in the first housing mating groove when the first and second connectors are mated together; and, reinforcing members disposed along the first housing end walls, the reinforcing members including center body portions extending along respective upper surfaces of the first housing end walls and tongue portions joined to the center body portions, the tongue portions extending at an angle to the center body portions and into the end wall recesses so as to define portions of the mating groove.

10. The board-to-board connector assembly of claim 9, wherein the reinforcing members each include corner portions disposed on opposite sides of the center body portions and extending at angles outwardly from the center portions.

11. The board-to-board connector assembly of claim 10, wherein the reinforcing members include tail portions for connecting to a surface of a circuit board.

12. The board-to-board connector assembly of claim 11, wherein the corner portions join the tail portions to the center body portions.

* * * * *